US007303011B2

(12) United States Patent
Reid et al.

(10) Patent No.: US 7,303,011 B2
(45) Date of Patent: Dec. 4, 2007

(54) DOWNHOLE FORMATION TESTING TOOL

(75) Inventors: Lennox Reid, Houston, TX (US); Edward Harrigan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/674,903

(22) Filed: Feb. 14, 2007

(65) Prior Publication Data

US 2007/0215349 A1 Sep. 20, 2007

Related U.S. Application Data

(63) Continuation of application No. 10/710,246, filed on Jun. 29, 2004, now Pat. No. 7,191,831.

(51) Int. Cl.
*E21B 47/00* (2006.01)
*E21B 49/08* (2006.01)

(52) U.S. Cl. ..... 166/264; 166/100

(58) Field of Classification Search ..... None
See application file for complete search history.

(56) References Cited

U.S. PATENT DOCUMENTS

| | | | |
|---|---|---|---|
| 2,020,856 | A | 12/1935 | Schlumberger |
| 2,509,883 | A | 5/1950 | Rolshausen et al. |
| 2,904,113 | A | 9/1959 | MacMahon |
| 3,653,436 | A | 4/1972 | Anderson et al. |
| 3,952,588 | A | 4/1976 | Whitten |
| 4,629,011 | A | 12/1986 | Reinhardt |
| 4,714,119 | A | 12/1987 | Hebert et al. |
| 4,860,581 | A | 8/1989 | Zimmerman et al. |
| 4,936,139 | A | 6/1990 | Zimmerman et al. |
| 5,163,522 | A | 11/1992 | Eaton et al. |
| 5,269,180 | A | 12/1993 | Dave et al. |
| 5,411,106 | A | 5/1995 | Maissa et al. |
| 5,667,025 | A | 9/1997 | Haessly et al. |
| 5,692,565 | A | 12/1997 | MacDougall et al. |
| 6,006,844 | A | 12/1999 | Van Puymbroeck et al. |
| 6,157,893 | A | 12/2000 | Berger et al. |
| 6,175,927 | B1 | 1/2001 | Cromer et al. |
| 6,223,822 | B1 | 5/2001 | Jones |
| 6,371,221 | B1 | 4/2002 | Harrigan et al. |
| 6,412,575 | B1 | 7/2002 | Harrigan et al. |
| 6,644,424 | B1 | 11/2003 | Fanuel |
| 6,672,407 | B2 | 1/2004 | Streich |
| 7,055,626 | B2 | 6/2006 | Wells et al. |
| 2005/0194134 | A1 | 9/2005 | McGregor et al. |

FOREIGN PATENT DOCUMENTS

| | | |
|---|---|---|
| EP | 0224408 | 6/1987 |
| GB | 2417045 | 2/2006 |
| WO | WO9423176 | 10/1994 |
| WO | WO9859146 | 12/1998 |

*Primary Examiner*—Frank Tsay
(74) *Attorney, Agent, or Firm*—Matthias Abrell; Kevin P. McEnaney; Dale V. Gaudier

(57) ABSTRACT

A downhole tool positionable in a wellbore penetrating a subterranean formation is disclosed. The downhole tool includes a housing, a coring bit and a sample chamber. The coring bit is disposed in the housing and is extendable therefrom for engaging a wellbore wall. The sample chamber stores at least two formation samples obtained with the coring bit and includes at least two portions for separately storing the formation samples.

17 Claims, 10 Drawing Sheets

DOWNHOLE FORMATION TESTING TOOL

CROSS REFERENCE TO RELATED APPLICATIONS

This application is a continuation application of U.S. patent application Ser. No. 10/710,246, filed Jun. 29, 2004, now U.S. Pat. No. 7,191,831 the content of which is incorporated herein by reference of all purposes.

BACKGROUND

Wells are generally drilled into the ground to recover natural deposits of oil and gas, as well as other desirable materials, that are trapped in geological formations in the Earth's crust. A well is drilled into the ground and directed to the targeted geological location from a drilling rig at the Earth's surface.

Once a formation of interest is reached, drillers often investigate the formation and its contents through the use of downhole formation evaluation tools. Some types of formation evaluation tools from part of a drill string and are used during the drilling process. These are called, for example, "logging-while-drilling" ("LWD") tools or "measurement-while-drilling" ("MWD") tools. Other formation evaluation tools are used sometime after the well has been drilled. Typically, these tools are lowered into a well using a wireline for electronic communication and power transmission. These tools are called "wireline" tools.

One type of wireline tool is called a "formation testing tool." The term "formation testing tool" is used to describe a formation evaluation tool that is able to draw fluid from the formation into the downhole tool. In practice, a formation testing tool may involve many formation evaluation functions, such as the ability to take measurements (i.e., fluid pressure and temperature), process data and/or take and store samples of the formation fluid. Thus, in this disclosure, the term formation testing tool encompasses a downhole tool that draws fluid from a formation into the downhole tool for evaluation, whether or not the tool stores samples. Examples of formation testing tools are shown and described in U.S. Pat. Nos. 4,860,581 and 4,936,139, both assigned to the assignee of the present invention.

During formation testing operations, downhole fluid is typically drawn into the downhole tool and measured, analyzed, captured and/or released. In cases where fluid (usually formation fluid) is captured, sometimes referred to as "fluid sampling, " fluid is typically drawn into a sample chamber and transported to the surface for further analysis (often at a laboratory).

As fluid is drawn into the tool, various measurements of downhole fluids are typically performed to determine formation properties and conditions, such as the fluid pressure in the formation, the permeability of the formation and the bubble point of the formation fluid. The permeability refers to the flow potential of the formation. A high permeability corresponds to a low resistance to fluid flow. The bubble point refers to the fluid pressure at which dissolved gasses will bubble out of the formation fluid. These and other properties may be important in making downhole decisions.

Another downhole tool typically deployed into a wellbore via a wireline is called a "coring tool." Unlike the formation testing tools, which are used primarily to collect sample fluids, a coring tool is used to obtain a sample of the formation rock.

A typical coring tool includes a hollow drill bit, called a "coring bit," that is advanced into the formation wall so that a sample, called a "core sample," may be removed from the formation. A core sample may then be transported to the surface, where it may be analyzed to assess, among other things, the reservoir storage capacity (called porosity) and permeability of the material that makes up the formation; the chemical and mineral composition of the fluids and mineral deposits contained in the pores of the formation; and/or the irreducible water content of the formation material. The information obtained from analysis of a core sample may also be used to make downhole decisions.

Downhole coring operations generally fall into two categories; axial and sidewall coring. "Axial coring," or conventional coring, involves applying an axial force to advance a coring bit into the bottom of the well. Typically, this is done after the drill string has been removed, or "tripped," from the wellbore, and a rotary coring bit with a hollow interior for receiving the core sample is lowered into the well on the end of the drill string. An example of an axial coring tool is depicted in U.S. Pat. No. 6,006,844, assigned to Baker Hughes.

By contrast, in "sidewall coring," the coring bit is extended radially from the downhole tool and advanced through the side wall of a drilled borehole. In sidewall coring, the drill string typically cannot be used to rotate the coring bit, nor can it provide the weight require to drive the bit into the formation. Instead, the coring tool itself must generate both the torque that causes the rotary motion of the coring bit and the axial force, called weight-on-bit ("WOB"), necessary to drive the coring bit into the formation. Another challenge of sidewall coring relates to the dimensional limitations of the borehole. The available space is limited by the diameter of the borehole. There must be enough space to house the devices to operate the coring bit and enough space to withdraw and store a core sample. A typical sidewall core sample is about 1.5 inches (~3.8 cm) in diameter and less than 3 inches long (~7.6 cm), although the sizes may vary with the size of the borehole. Examples of sidewall coring tools are shown and described in U.S. Pat. Nos. 4,714,119 and 5,667,025, both assigned to the assignee of the present invention.

Like the formation testing tool, coring tools are typically deployed into the wellbore on a wireline after drilling is complete to analyze downhole conditions. The additional steps of deploying a wireline formation testing tool, and then also deploying a wireline coring tool further delay the wellbore operations. It is desirable that the wireline formation testing and wireline coring operations be combined in a single wireline tool. However, the power requirements of conventional coring tools have been incompatible with the power capabilities of existing wireline formation testers. A typical sidewall coring tool requires about 2.5-4 kW of power. By contrast, conventional formation testing tools are typically designed to generate only about 1 kW of power. The electronic and power connections in a formation testing tool are generally not designed to provide the power to support a wireline sidewall coring tool.

it is noted that U.S. Pat. No. 6,157,893, assigned to Baker Hughes, depicts a drilling tool with a coring tool and a probe. Unlike wireline applications, drilling tools have additional power capabilities generated from the flow of mud through the drill string. The additional power provided by the drilling tool is currently unavailable for wireline applications. Thus, there remains a need for a wireline assembly with both fluid sampling and coring capabilities.

It is further desirable that any downhole tool with combined coring and formation testing capabilities provide one or more of the following features, among others: enhanced testing and/or sampling operation, reduced tool size, the ability to perform coring and formation testing at a single location in the wellbore and/or via the same tool, and/or convenient and efficient combinability of separate coring and sampling tools into the same component and/or downhole tool.

SUMMARY

In one aspect of the disclosure, a downhole tool having a housing and a coring bit disposed therein is disclosed. The coring bit is extendable from the housing for engaging a wellbore wall, and the sample chamber stores at least two formation samples obtained with the coring bit. The sample chamber further includes at least two portions for separately storing the formation samples.

In another aspect of the disclosure, a sample storage assembly for a downhole coring tool is disclosed. The sample storage assembly includes a first portion for receiving a first sample, and a second portion for receiving a second sample, such that the first and second samples are selectively isolated.

In another aspect of the disclosure, a method of storing a plurality of samples obtained from a subterranean formation is disclosed. The method includes removing a first sample from a coring bit, placing the first sample into an opening defining an entrance into a storage assembly, sealing the first sample in a first portion of the storage assembly, removing a second sample from a coring bit, placing the second sample into the opening, and sealing the second sample in a second portion of the storage assembly, wherein the first and second samples are isolated from each other.

In yet another aspect of the disclosure, a method of storing a plurality of samples obtained from a subterranean formation is disclosed. The method placing a first sample into a first portion of a storage assembly, the first portion having a first end and a second end, sealing the second end of the first portion, thereby defining a first end of a second portion, and placing a second sample into the second portion of the storage assembly.

Other aspects and advantages of the invention will be apparent from the following description and the appended claims.

DETAILED DESCRIPTION

Some embodiments of the present invention relate to a wireline assembly that includes a low-power coring tool that may be connected to a formation testing tool. Other embodiments of the invention relate to a field joint that may be used to connect a coring tool to a formation testing tool. Some embodiments of the invention relate to a downhole tool that includes a combined formation testing and a coring assembly.

Figure 1:
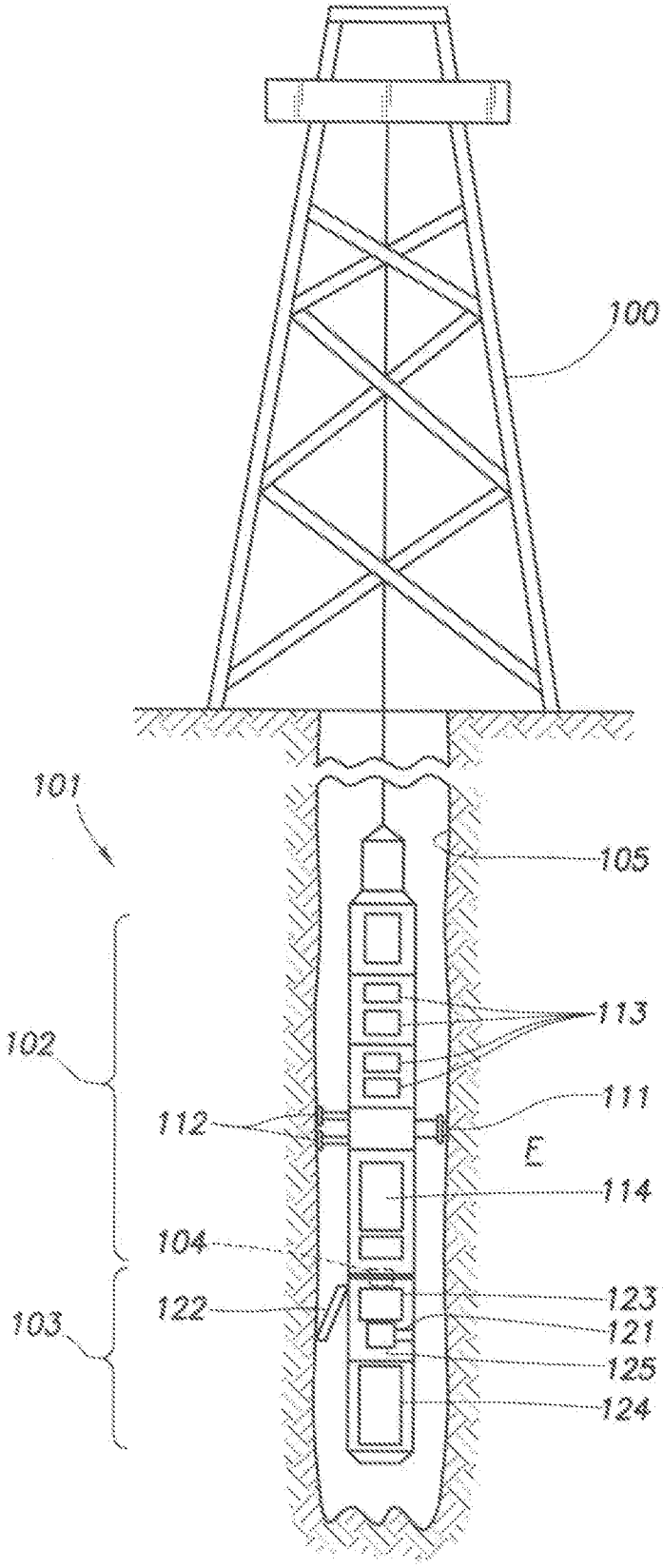
FIG. 1 shows a schematic of a wireline assembly that includes a formation testing tool and a coring tool.

FIG. 1 shows a schematic of a wireline apparatus 101 deployed into a wellbore 105 from a rig 100 in accordance with one embodiment of the invention. The wireline apparatus 101 includes a formation testing tool 102 and a coring tool 103. The formation testing tool 102 is operatively connected to the coring tool 103 via field joint 104.

The formation testing tool 102 includes a probe 111 that may be extended from the formation testing tool 102 to be in fluid communication with a formation F. Back up pistons 112 may be included in the tool 101 to assist in pushing the probe 111 into contact with the sidewall of the wellbore and to stabilize the tool 102 in the borehole. The formation testing tool 102 shown in FIG. 1 also includes a pump 114 for pumping the sample fluid through the tool, as well as sample chambers 113 for storing fluid samples. Other components may also be included, such as a power module, a hydraulic module, a fluid analyzer module, and other devices.

Figure 5:
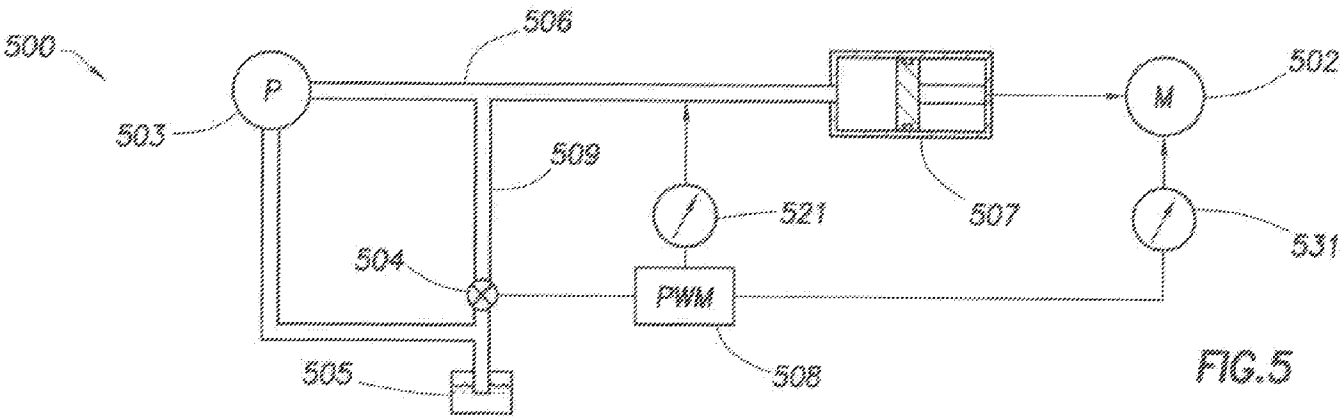
FIG. 5 shows a schematic of a weight-on-bit control system in accordance with one embodiment of the invention.

The coring tool 103 includes a coring assembly 125 with a coring bit 121, a storage area 124 for storing core samples, and the associated control mechanisms 123 (e.g., the mechanisms shown in FIG. 5). In some embodiments, as will be described later with reference to FIG. 2B, the coring tool 103 consumes less than about 2 kW of power. In certain specific embodiments, a coring tool 103 may consume less than about 1.5 kW, and in at least one embodiment, a coring tool 103 consumes less than 1 kW. This makes it desirable to combine the coring tool 103 with the formation testing tool 102. The brace arm 122 is used to stabilize the tool 101 in the borehole (not shown) when the coring bit 121 is functioning.

The apparatus of FIG. 1 is depicted as having multiple modules operatively connected together. However, the apparatus may also be partially or completely unitary. For example, as shown in FIG. 1, the formation testing tool 102 may be unitary, with the coring tool housed in a separate module operatively connected by field joint 104. Alternatively, the coring tool may be unitarily included within the overall housing of the apparatus 101.

Downhole tools often include several modules (i.e., sections of the tool that perform different functions). Additionally, more than one downhole tool or component may be combined on the same wireline to accomplish multiple downhole tasks in the same wireline run. The modules are typically connected by "field joints." such as the field joint 104 of FIG. 1. For example, one module of a formation testing tool typically has one type of connector at its top end and a second type of connector at its bottom end. The top and bottom connectors are made to operatively mate with each other. By using modules and tools with similar arrangements of connectors, all of the modules and tools may be connected end to end to form the wireline assembly. A field joint may provide an electrical connection, a hydraulic connection, and a flowline connection, depending on the requirements of the tools on the wireline. An electrical connection typically provides both power and communication capabilities.

In practice, a wireline tool will generally include several different components, some of which may be comprised of two or more modules (e.g., a sample module and a pumpout module of a formation testing tool). In this disclosure, "module" is used to describe any of the separate tools or individual tool modules that may be connected in a wireline assembly. "Module" describes any part of the wireline assembly, whether the module is part of a larger tool or a separate tool by itself. It is also noted that the term "wireline tool" is sometimes used in the art to describe the entire wireline assembly, including all of the individual tools that make up the assembly. In this disclosure, the term "wireline assembly" is used to prevent any confusion with the individual tools the make up the wireline assembly (e.g., a coring tool, a formation testing tool and an NMR tool may all be included in a single wireline assembly).

Figure 2B:
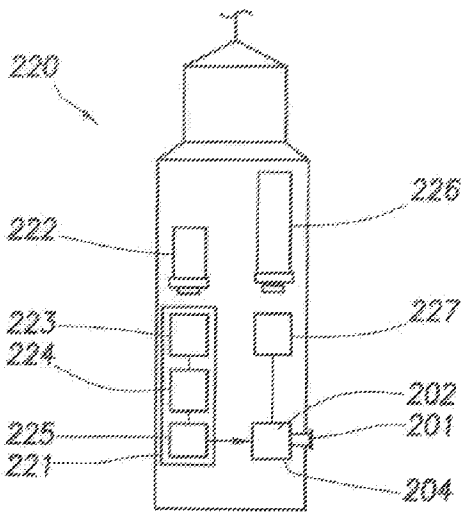
FIG. 2B shows a schematic of a coring tool in accordance with one embodiment of the invention.
Figure 2A:
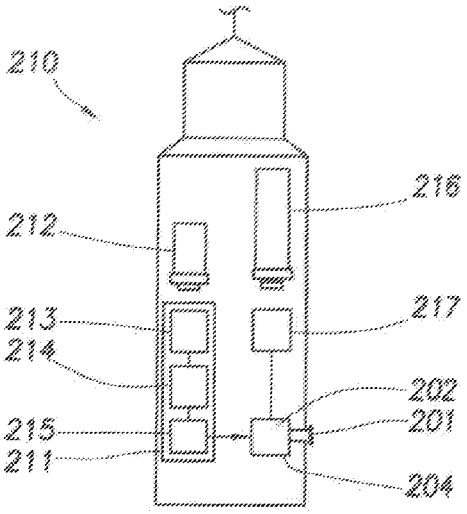
FIG.2A (PRIOR ART)
FIG. 2A is a schematic of a prior art coring tool.

FIG. 2A is a schematic of a prior art wireline coring tool 210. The coring tool 210 includes a coring assembly 204 with a hydraulic coring motor 202 that drives a coring bit 201. The coring bit 201 is used to remove a core sample (not shown) from a formation.

In order to drive the coring bit 201 into the formation, it must be pressed into the formation while it is being rotated. Thus, the coring tool 210 applies a weight-on-bit ("WOB") (i.e., the force that presses the coring bit 201 into the formation) and a torque to the coring bit 201. The coring tool 210 shown in FIG. 2A includes mechanisms to apply both. Examples of a coring apparatus with mechanisms for applying WOB and torque are disclosed in U.S. Pat. No. 6,371,221, assigned to the assignee of the present invention.

The WOB in prior art coring tool 210 is generated by an AC motor 212 and a control assembly 211 that includes a hydraulic pump 213, a feedback flow control ("FFC") valve 214, and a kinematics piston 215. The AC motor 212 supplies power to the hydraulic pump 213. The flow of hydraulic fluid from the hydraulic pump 213 is regulated by the FFC valve 214, and the pressure of hydraulic fluid drives the kinematics piston 215 to apply a WOB to the coring bit 201.

The torque is supplied by another AC motor 216 and a gear pump 217. The second AC motor 216 drives the gear pump 217, which supplies a steady flow of hydraulic fluid to the hydraulic coring motor 202. The hydraulic coring motor 202, in turn, imparts a torque to the coring bit 201 that causes the coring bit 201 to rotate. Typically, the gear pump 217 pumps about 4.5 gpm (~17 lpm) of hydraulic fluid at a pressure of about 500 psi (~3.44 MPa). This generates a torque of about 135 in.-oz. (~0.953 N-M) while consuming between 2.5 kW and 4.0 kW, depending on the efficiency of the system. A typical operating speed of the coring bit 201 is about 3,000 rpm.

Referring now to FIG. 2B, a coring tool 220 in accordance with one embodiment of the invention uses two brushless DC motors 222, 226 in place of the AC motors of FIG. 2A. The brushless DC motors 222, 226 are designed to operate more efficiently than the AC motors, enabling the tool 220 to be operated with less power. The coring tool 220 of FIG. 2B may be used, for example, in the coring tool 103 of FIG. 1. While the lower power capabilities of the coring tool make it usable in wireline applications (with or without an accompanying formation tester), it may also be usable in other downhole tools.

The first brushless DC motor 222 is operatively connected to a control assembly 221 including a hydraulic pump 223, a valve 224, and a kinematics piston 225. The DC motor 222 drives the hydraulic pump 223, and hydraulic fluid is pumped through a valve 224. The valve 224 is preferably a pulse-width modulated ("PWM") solenoid valve. The valve may be operated in a manner to control the WOB. As will be described with reference to FIGS. 6A and 6B, below, the solenoid valve may be controlled so that a kinematics piston 225 applies a constant WOB or so that the WOB is changed to maintain a constant torque on the coring bit 201.

A second brushless DC motor 226 drives a high pressure gear pump 227 that supplies hydraulic fluid to the hydraulic coring motor 202. In some embodiments, the high pressure gear pump 227 is use to deliver hydraulic fluid at a higher pressure and a lower flow rate than in prior art coring tools. This system provides what is referred to herein as "low-power." For example, the coring tool 220 shown in FIG. 2B may pump hydraulic fluid at a rate of about 2.5 gpm (~9.46 lpm) at a pressure of about 535 psi (~3.7 MPa). The reduced flow rate of hydraulic fluid to the hydraulic coring motor 202 will operate the coring bit 201 at a lower speed. For example, a flow rate of 2.5 gpm at 535 psi (~9.46 lpm and ~3.7 MPa) may generate a coring bit speed of about 1,600 rpm.

Such a configuration may enable a coring tool 220 to consume less than 2 kW of power. In certain embodiments, a coring tool 220 may consume less than 1 kW of power.

Figure 3:
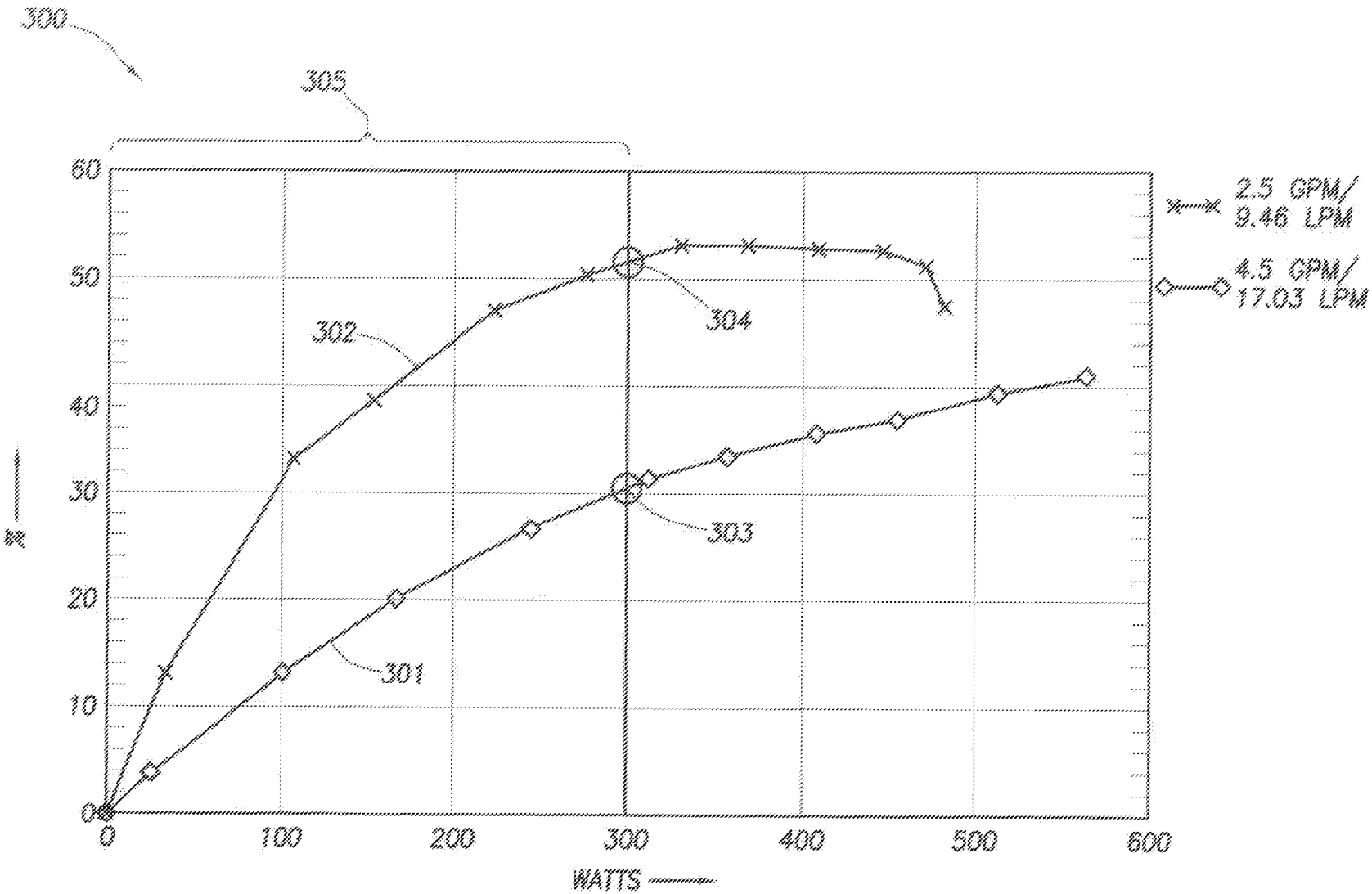
FIG. 3 shows a chart that shows the efficiency of a coring motor as a function of power output for two different flow rates of hydraulic fluid to a coring motor.

FIG. 3 shows a graph 300 of the efficiency of a coring motor (Y-axis in %) versus the power output (X-axis in Watts) for two coring tools. This graph compares the efficiency versus power for the coring tool 210 of FIG. 2A and the coring tool 220 of FIG. 2B, within the operating range of up to about 300 Watts of power.

The first curve 301 shows the efficiency of coring motor 202 of FIG. 2A at a flow rate of 4.5 gpm (~17.03 lpm). At 300 W, a typical maximum power output for a coring tool, the efficiency reaches its maximum 303 of about 30%. The second curve 302 shows the efficiency of the coring motor 202 of FIG. 2B at a flow rate of 2.5 gpm (~9.46 lpm). The second curve 302 shows a maximum efficiency 304 of over 50% at the 300 W of output. Thus, by reducing the flow rate from 4.5 gpm (~17.03 lpm) to 2.5 gpm (~9.46 lpm), the efficiency of the coring motor can be increased to over 50%. At 300 W of power output, a coring motor with a 50% efficiency would require less than 1 kW of input power. This reduction in the required power enables a coring tool to be used in conjunction with a formation testing tool.

Figure 4:
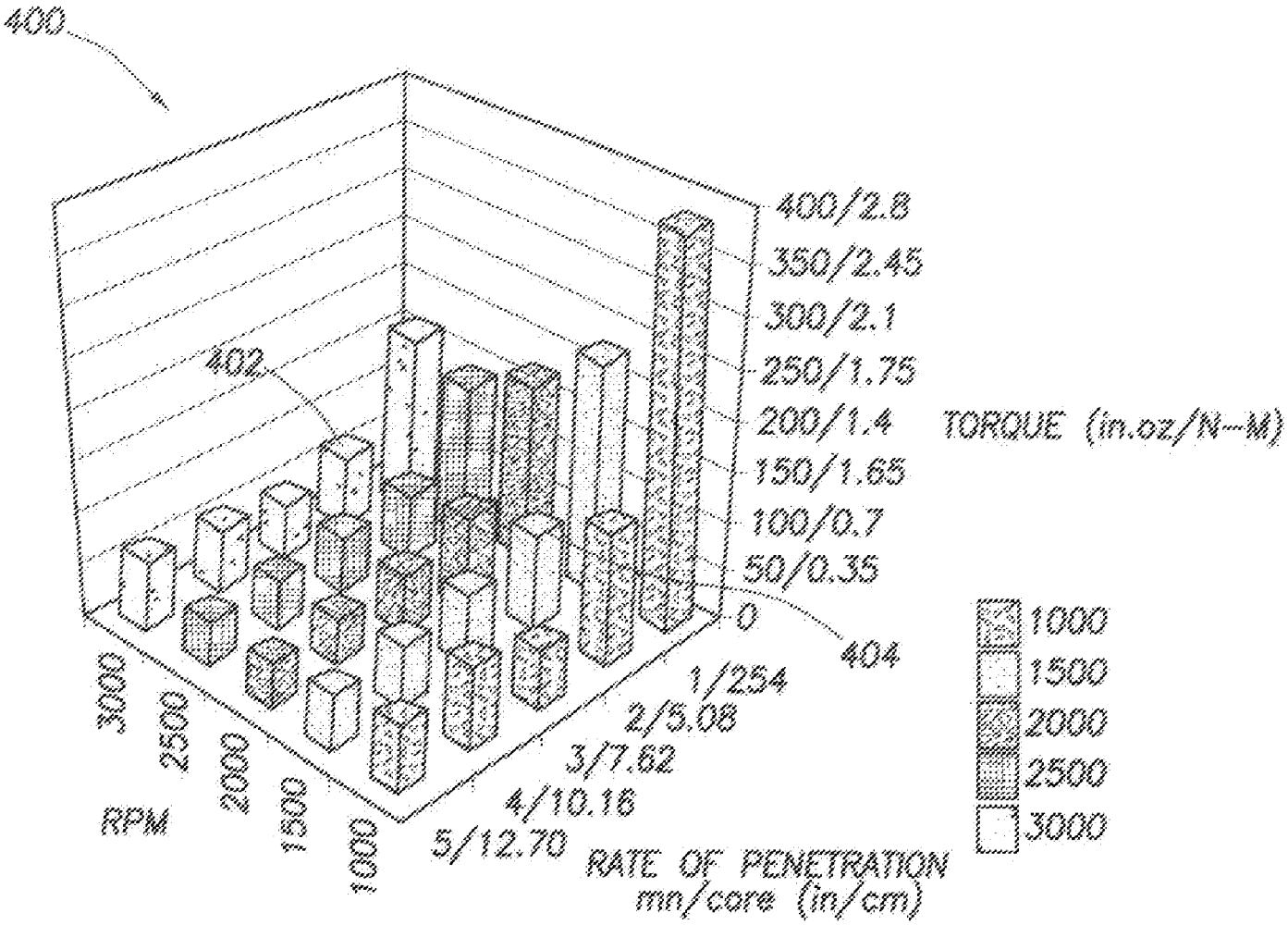
FIG. 4 shows a graph of the torque required by a coring bit as a function of rotary speed and rate of penetration.

FIG. 4 shows a three-dimensional graph 400 of the required torque based on rpm and rate of penetration ("ROP") for a typical formation. A typical coring tool drills a core sample in about 2-4 minutes. In that range, the required torque does not change much with respect to the speed of the drill bit. For example, at the point 402 for 3,000 rpm and 2 min/core, the coring tool will require slightly more than 100 in.-oz. of torque (~0.706 N-M). At the point 404 for 1,500 rpm and 2 min/core, the drill bit also requires slightly more than 100 in.-oz. of torque (~0.706 N-M). Thus, a coring tool in accordance with certain embodiments of the invention is designed to drill and obtain a core sample in the same amount of time as prior art coring tools, while using low power.

Typical formation testing tools are generally incapable of transmitting the power required by prior art coring tools. The low-power coring tool of FIG. 2B may consume less than about 1 kW of power. With this reduced power requirement, one or more embodiments of a low-power coring tool may be combined with a formation testing tool so that both fluid samples and core samples may be obtained during the same wireline run. An additional advantage is that a fluid sample and a core sample may be obtained from the same location in the borehole, enabling the analysis of both the formation rock and the fluid that it contains. The coring and testing tools may be positioned to perform tests and/or take samples from the same or relative locations. Still, a person having ordinary skill in the art will realize that one or more of the advantages of the present invention may be realized even without the use of a low-power coring tool.

FIG. 5 shows a control assembly 500 for regulating the WOB on a coring bit. The control assembly may be used, for example as the control assembly for the coring tool of FIG. 2B. The control assembly 500 includes a hydraulic pump 503 that pumps hydraulic fluid through a hydraulic line 506 to a kinematics piston 507. The hydraulic pump 503 draws hydraulic fluid from a reservoir 505 and pumps the hydraulic fluid to the kinematics piston 507 though a flowline 506. The kinematics piston 507 converts the hydraulic pressure to a force that acts on the coring motor 502 to provide a WOB. A valve 504 in a relief line 509 enables hydraulic fluid to be diverted from the flowline 506 in a controlled manner so that the hydraulic pressure in the flowline 506, and ultimately the kinematics piston 507, is precisely controlled.

The valve 504 may be a pulse-width modulated ("PWM") solenoid valve. The valve 504 is operatively connected to a PWM controller 508. The controller 508 operates the valve based on inputs from sensors 521, 531. Preferably, a PWM solenoid valve (i.e., valve 504) is switched between the open position and the closed position at a high frequency. For example, the valve 504 may be operated at a frequency between about 12 Hz and 25 Hz. The fraction of the time that the valve 504 is open will control the amount of hydraulic fluid that flows through the valve 504. The greater flow rate through the valve 504, the lower the pressure in the flowline 506 and the lower the WOB applied by the kinematics piston 507. The smaller the flow rate through the valve 504, the greater the pressure in the flowline 506 and the greater the WOB applied by the kinematics piston 507.

A PWM controller 508 may be operatively connected to one or more sensors 521, 531. Preferably, the PWM controller 508 is coupled to at least a pressure sensor 521 and a torque sensor 531. The pressure sensor 521 is coupled to the flowline 506 so that it is responsive to the hydraulic pressure in the flowline 506, and the torque sensor 531 is coupled to the coring motor 502 so that it is responsive to the torque output of the coring motor 502.

The valve 504 may be controlled so as to maintain an operating characteristic at a desired value. For example, the valve 504 may be controlled to maintain a substantially constant WOB. The valve 504 may also be controlled to maintain a substantially constant torque output of the coring motor 502.

When the valve 504 is controlled to maintain a constant WOB, the PWM controller 508 will control the valve 504 based on input from the pressure sensor 521. When the WOB becomes too high, the controller 508 may operate the valve 504 to be in an open position a higher fraction of the time. Hydraulic fluid in the flow line 506 may then flow through the valve 504 at a higher flowrate, which will reduce the pressure to the kinematics piston 507, thereby reducing the WOB.

Conversely, when the WOB falls below the desired pressure, the controller 508 may operate the valve 504 to be in an closed position a higher fraction on the time. Hydraulic fluid in the flow line 506 flows through the valve 504 at a lower flowrate, which will increase the pressure to the kinematics piston 507, thereby increasing the WOB.

When controlling the system based on torque, the torque sensor 531 measures the torque that is applied to the coring motor. For a given rotary speed, the torque applied by the coring motor 502 will depend on the formation properties and the WOB. The controller 518 operates the valve 504 so that the torque output of the coring motor 502 remains near a constant level. The desired torque output may vary depending on the tool and the application. In some embodiments, the desired torque output is between 100 in.-oz. (~0.706 N-M) and 400 in.-oz. (~2.82 N-M). In some embodiments, the desired torque output is about 135 in.-oz. (~0.953 N-M). In other embodiments, the desired torque output is about 250 in.-oz. (~1.77 N-M).

When the torque output of the coring motor 502 is above the desired level, the controller 508 operates the valve 504 to be open a higher fraction of the time. A higher flow rate of hydraulic fluid flows through the valve 504. This decreases the pressure in the flow line 506, which decreases the hydraulic pressure in the kinematics piston 507. A decreased pressure in the kinematics piston 507 will result in a decreased WOB and a decreased torque required to maintain the rotary speed of the coring bit (not shown in FIG. 5). Thus, the torque output of the coring motor 502 will return to the desired level.

When the torque output of the coring motor 502 is below the desired level, the controller 508 operates the valve 504 to be in a closed position a higher fraction of the time. Hydraulic fluid flows through the valve 504 at a lower flow rate. This increases the pressure in the flow line 506, which increases the hydraulic pressure in the kinematics piston 507. An increased pressure in the kinematics piston 507 will result in an increased WOB and an increased torque required to maintain the rotary speed of the coring bit.

FIG. 5 shows a control system 500 that may control WOB to maintain a constant WOB or to maintain a constant torque on the coring bit. Other systems may include only one sensor and control a valve based on only one sensor measurements. Such embodiments do not depart from the scope of the invention.

FIG. 5 shows a configuration where, for example, the valve 504 is connected in a relief line 509 that flows to a reservoir 508. The invention, however, is not so limited. Other configurations are envisioned, such as where the valve diverts flow in other ways, as is known in the art. Additionally, various combinations of pressure and/or torque control may be used.

Figure 6:
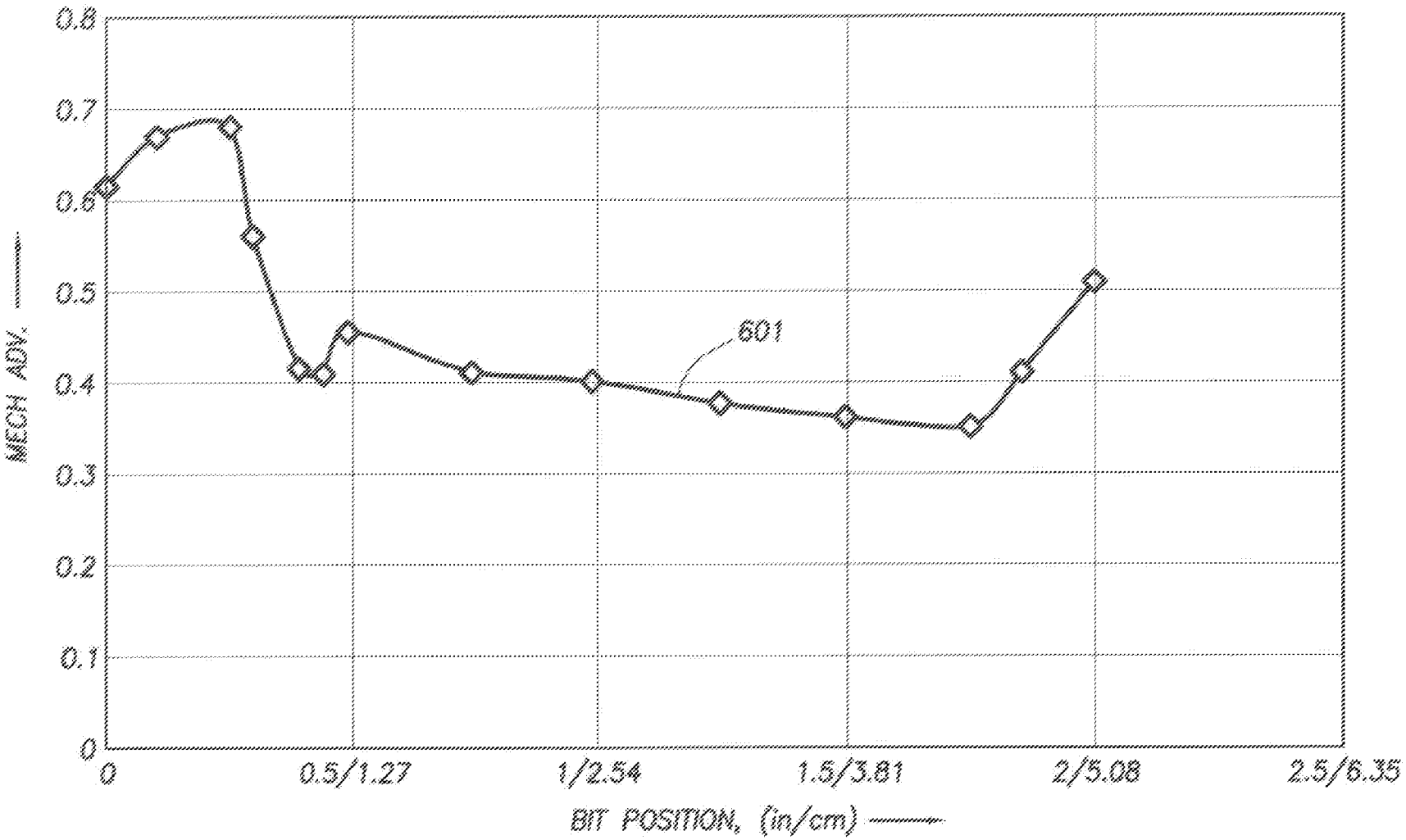
FIG. 6 shows a graph showing the mechanical advantage of a coring bit as a function of bit position for a typical coring bit.

FIG. 6 is a graph that shows the mechanical advantage (Y-axis) for the WOB based on bit position (X-axis in inches/centimeters) for a typical coring tool. The plot 601 shows that the mechanical advantage varies over the range of the bit position. Because the mechanical advantage varies, the actual WOB will also vary with bit position, even if the hydraulic pressure applied to the kinematics piston (e.g., 516 in FIG. 5) is constant. This graph indicates that carefully maintaining the hydraulic pressure will not generally maintain a constant WOB. Thus, in some situations it is preferable to control hydraulic pressure based on torque.

Figure 7B:
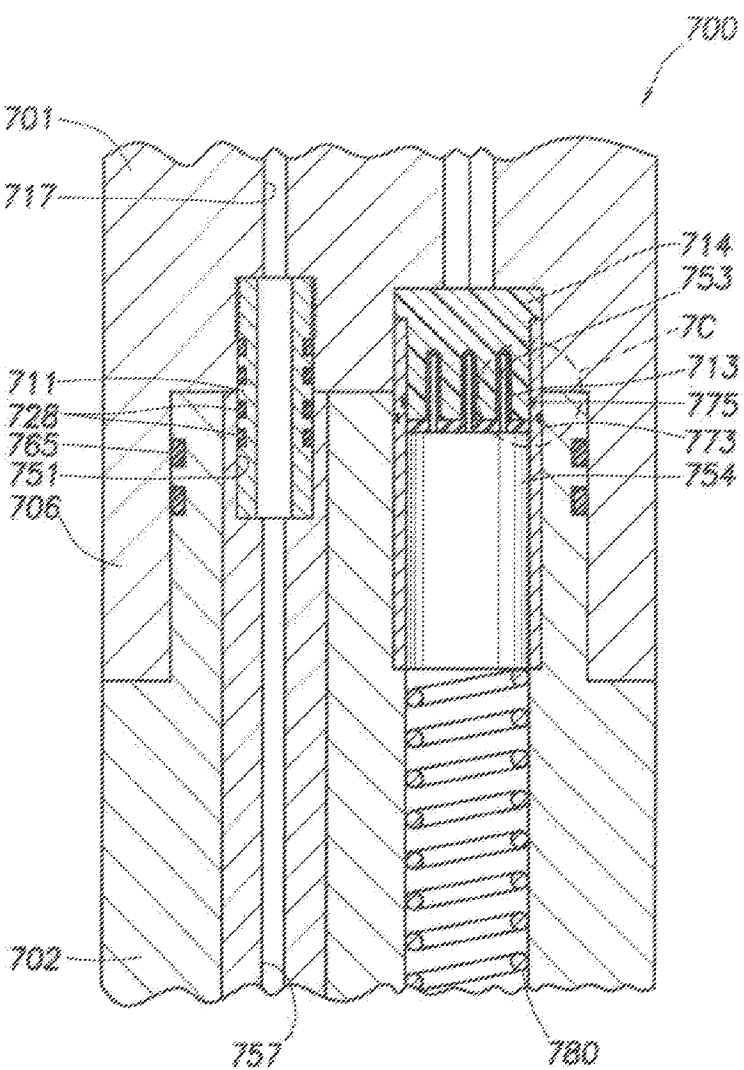
FIG. 7B shows a cross section of a field joint prior to make-up, in accordance with one embodiment of the invention.
Figure 7A:
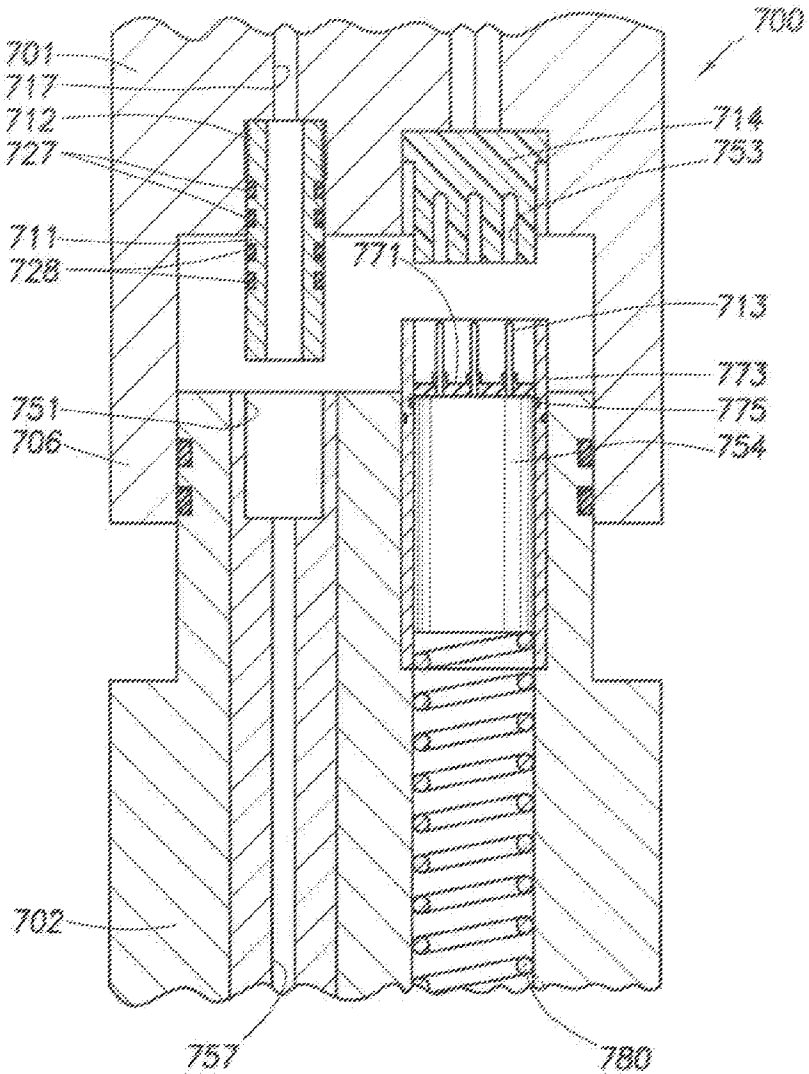
FIG. 7A shows a cross section of a field joint before make-up, in accordance with one embodiment of the invention.

FIGS. 7A and 7B show cross sections of a field joint 700 in accordance with one embodiment of the invention. The field joint 700 may be used, for example, as the field joint 104 of FIG. 1. This field joint may be used to combine various components or modules of any downhole tool, such as a wireline, coiled tubing, drilling or other tool. FIG. 7A shows an upper module 701 and a lower module 702 just before make-up. The upper module 701 includes a cylindrical sleeve 706 into which the lower module 702 fits.

The upper module 701 includes a male flowline connector 711 with seals 727 to prevent fluid from passing around the mate flowline connector 711. The male flowline connector 711 may, for example, be threaded onto the upper module 701 (e.g., at area shown generally at 712). A female flowline connector 751 in the lower module 702 is positioned to receive the male flowline connector 711 when the field joint 700 is made-up (made-up condition shown in FIG. 7B). The flowline connector 711 connects the flowline 717 in the upper module 701 to the flowline 757 in the lower module 702 so that there is fluid communication between the flow lines 717, 757.

The upper module 701 also includes a female socket bulkhead 714. Socket holes 753 are located in the female socket bulkhead 714. The socket holes 753 are positioned in the upper module 701 to prevent extraneous fluids from being trapped or collected in the socket holes 753.

The lower module 702 includes a male pin bulkhead 754 with male pins 713 that extend upwardly from male pin bulkhead 754. The male pin bulkhead 754 and the male pins 713 are disposed in a protective sleeve 773. In some embodiments, the protective sleeve 773 is slightly higher than the top of the male pins 713. In some embodiments, the male pin bulkhead 754 is moveable with respect to the lower module 702 and the protective sleeve 773. For example, FIG. 7A shows a spring 780 that pushes the male pin bulkhead 754 into an upper most position.

Figure 7C:
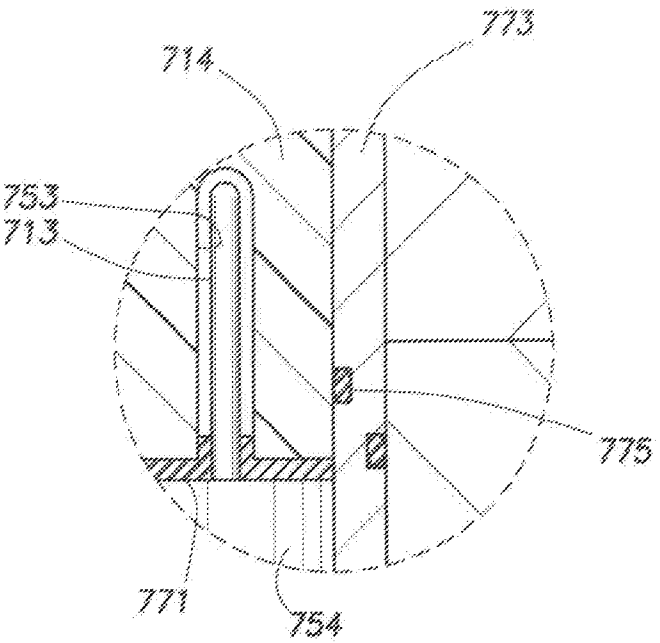
FIG. 7C shows an enlarged section of a cross section of a field joint prior to make-up, in accordance with one embodiment of the invention.

Optionally, the upper surface of the male pin bulkhead 754 is covered by an interfacial seal 771 that is bonded to the top of bulkhead 754 and has raised bosses that seal around each male pin 713. The interfacial seal 771 is shown in more detail in FIG. 7C. The male pins 713 extend upwardly from the male pin bulkhead 751. A interfacial seal 771 is disposed at the top of the male pin bulkhead 754. The interfacial seal 771 is preferably an elastomeric material, such as rubber, disposed around the male pins 713 to prevent fluid from entering the male pin bulkhead 754 and interfering with any circuitry that may be located inside the male pin bulkhead 754. Additionally, the interfacial seal 771 seals against the face of bulkhead 714 to force fluid from the space between the male pin bulkhead 754 and the female socket bulkhead 714. FIG. 7C shows a close-up made-up position. The raised bosses around each pin on the interfacial seal 771 seals the female socket holes 753 so that fluid may not enter the electrical connection area once the modules 701, 702 are made up. This seal configuration is used to isolate each pin/socket electrically from other pins and from the tool mass.

The protective sleeve 773 may be perforated or porous. This enables fluids trapped within the protective sleeve 773 to flow through the protective sleeve to a position where the fluids will not interfere with the electrical connection between the male pins 713 and the female socket holes 753 when the field joint 700 is made-up.

FIG. 7B shows a cross section of the field joint 700 after make-up. The lower module 702 is positioned inside the cylindrical sleeve 706 of the upper module 701. The seals 765 (e.g., o-rings) on the lower module 702 seal against the inside wall of the cylindrical housing 706 to prevent fluid from entering the field joint 700.

The male flowline connector 711 of the upper module 701 is received in the female flowline connector 751 of the lower module 702. Seals 728 on the male flowline connector 711 seal against the inner surface of the female flowline connector 751 to prevent fluid from flowing around the flow connector 711. In the made-up position, the male flow connector 711 establishes fluid communication between the flowline 717 in the upper module 701 and the flow line 757 in the lower module 702.

It is noted that this description refers to seals that are positioned in one member to seal against a second member. A person having ordinary skill in the art would realize that a seal could be disposed in the second member to seal against the first. No limitation is intended by any description of a seal being on or disposed in a particular member. Alternate configurations do not depart from scope of the invention.

In the made-up position, the female socket bulkhead 714 pushes downwardly on the male pin bulkhead 754. The spring 780 allows for the downward movement of male pin bulkhead 754. The male pins 713 are positioned in the female socket holes 753 to make electrical contact. The female socket bulkhead 714 is positioned at least partially inside the protective sleeve 773.

In the field joint shown in FIG. 7B, the protective sleeve 773 remains stationary with respect to the lower module 702. The male pins 713 are also preferably located within the protective sleeve 773. During make-up, the female pins bulkhead fits into the protective sleeve 773 to mate with the male pins 713 on the male pin bulkhead 754, while pushing the male pin bulkhead 754 downwardly.

FIG. 7C shows a close-up view of one section of the field joint (700 in FIGS. 7A and 7B) in the made-up position. The lower face of female socket bulkhead 714 is positioned against the interfacial seal 771 on the top of the male pin bulkhead 754. The male pins 713 are received in the female socket holes 753. The interfacial seal 771 seals the female socket holes 753 so that fluid cannot enter the electrical contact area once the modules 701, 702 are made-up.

The protective sleeve 773 may include a seal 775. In the non-made-up position (shown in FIG. 7A), the seal 775 seals against the male pin bulkhead 754 to prevent fluid from entering the lower module (702 in FIGS. 7A and 7B). In the made-up position in FIGS. 7B and 7C, the female socket bulkhead 714 is positioned to be in contact with the seal 775. In the made-up configuration, the seal 775 prevents fluid in the field joint from entering the area between the male pin bulkhead 754 and the female pin bulkhead 714 and interfering with the electrical contact. The seal 775 is also used to prevent fluid in the field joint from entering the lower module 702.

As discussed above, the protective sleeve 773 may be perforated or porous to allow fluid to flow through the protective sleeve 773. The protective sleeve 773 may be porous above the seal 775, but fluid cannot flow through the protective sleeve 773 below the seal 775. The seal 775 prevents fluid from flowing through the porous protective sleeve 773 and into a position between the male pin bulkhead 754 and the female pin bulkhead 714, and into the lower module 702.

Figure 8A:
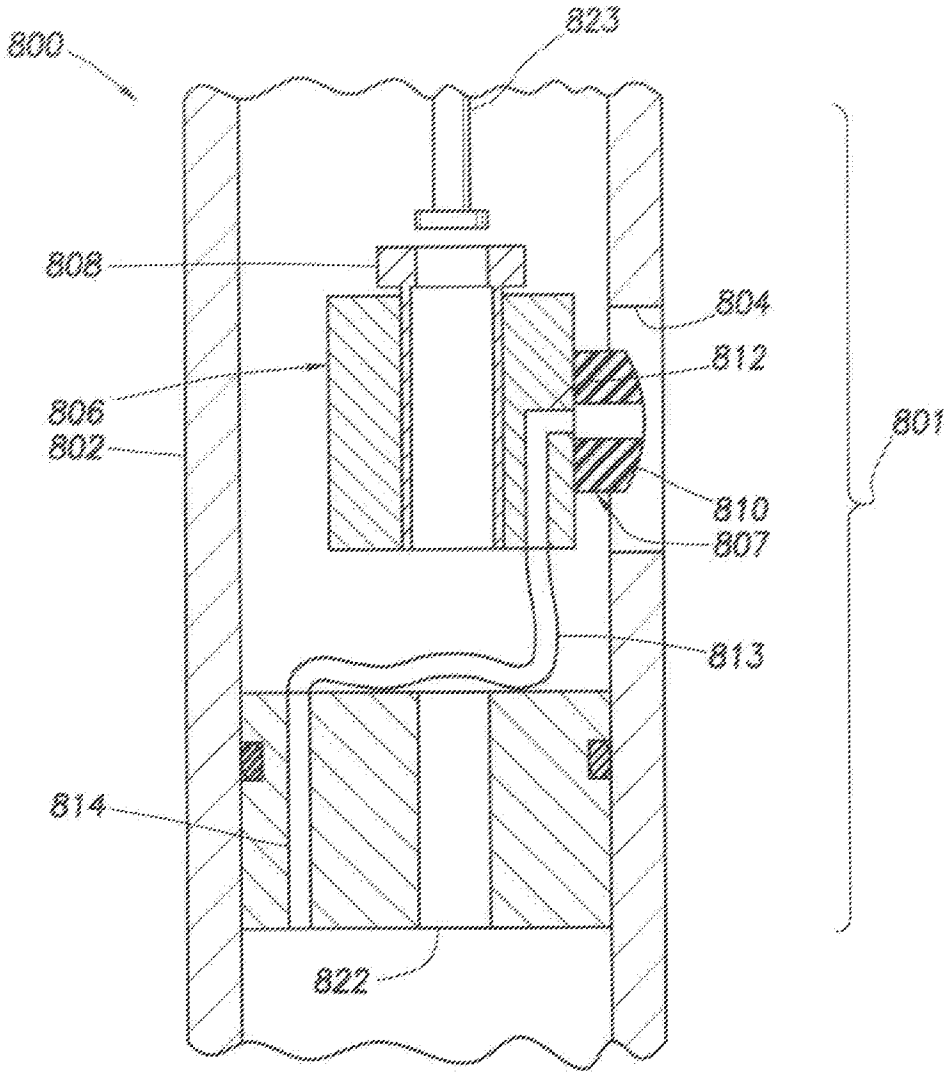
FIG. 8A shows a cross section of a portion of a downhole tool in accordance with one embodiment of the invention.
Figure 8C:
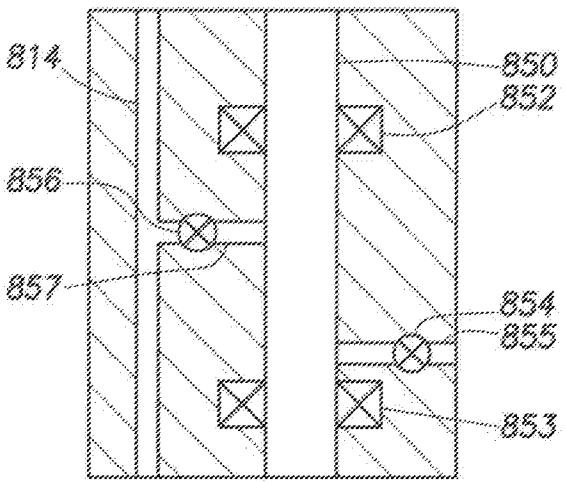
FIG. 8C shows a cross section of a portion of a downhole tool in accordance with one embodiment of the invention.
Figure 8B:
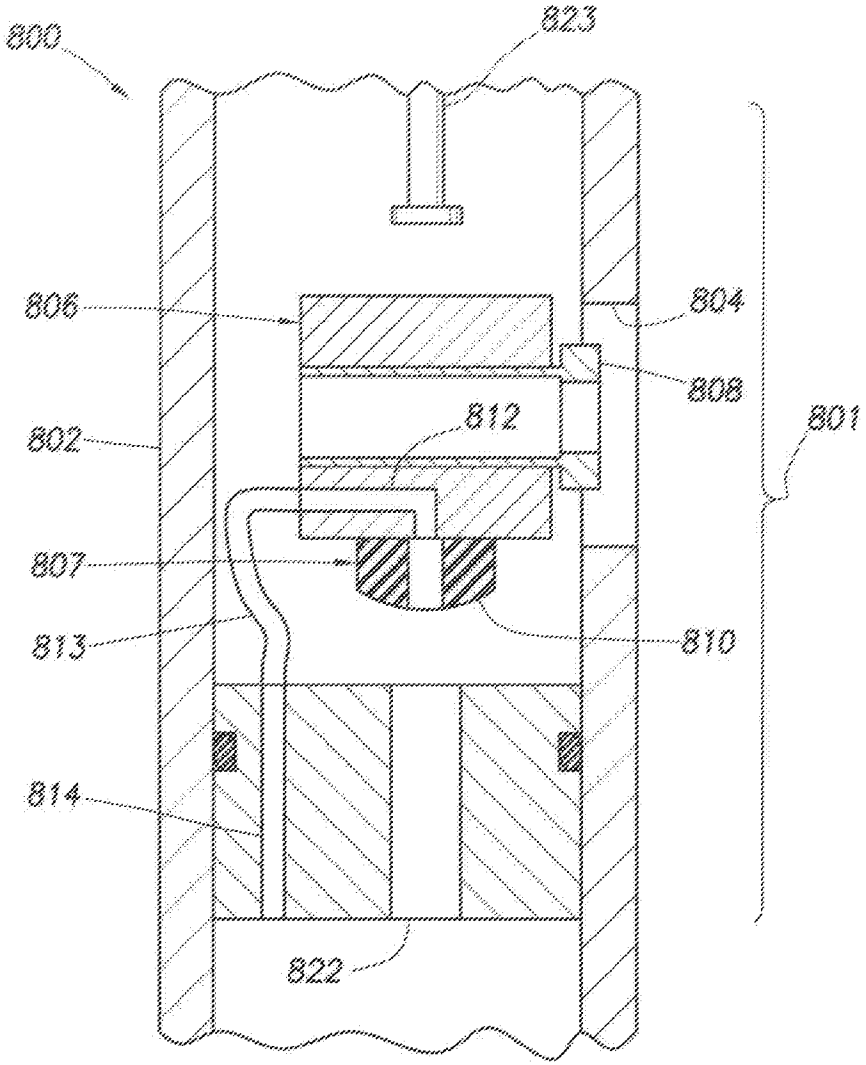
FIG. 8B shows a cross section of a portion of a downhole tool in accordance with one embodiment of the invention.
Figure 9:
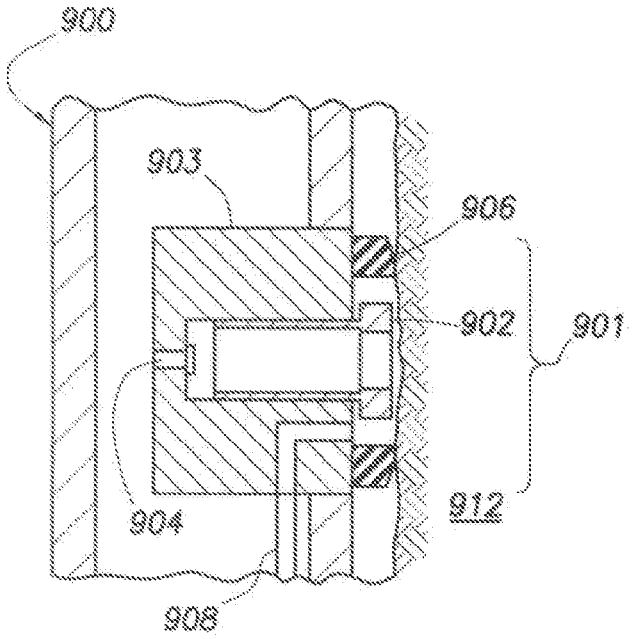
FIG. 9 shows a cross section of a portion of a downhole tool in accordance with one embodiment of the invention.

FIGS. 8 and 9 show formation evaluation tools that include both coring and sampling capabilities. Such a tool may be a wireline tool or it may form part of other downhole tools, such as a drilling tool, coiled tubing tool, completion tool or other tool.

FIG. 8A shows a cross section of a downhole tool 800 with a combined formation testing and coring assembly 801 in accordance with one embodiment of the invention. The combined assembly may be positioned in the downhole tool or housed in a module combinable with the downhole tool.

The downhole tool 800 has a tool body 802 that surrounds the combined assembly 801. An opening 804 in the roof body 802 enables core samples and fluid samples to be obtained from the formation. The opening 804 is preferably selectively closable to prevent the flow of fluid into the downhole tool. The combined assembly 801 includes a sampling block 806. The sampling block 806 is positioned adjacent to the opening 804 so that the sampling block 806 has access to the opening 804.

The sampling block 806 may include a fluid probe 807 and a coring bit 808 on adjacent sides. The sampling block 806 may be rotated so that either of the fluid probe 807 and the coring bit 808 is in a position to access the opening 804. FIG. 8A shows a sampling block 806 in a position with the fluid probe 807 in a position to access the opening 804.

The exact design of a fluid probe is not intended to limit the invention. The following description is provided only as an example. The fluid probe 807 includes a sealing surface 810, such as a packer, for pressing against the borehole wall (not shown). When the sealing surface 810 creates a seal against the borehole wall, the flowline 812 in the fluid probe 807 is placed in fluid communication with the formation. The sealing surface 810 may comprise a packet or other seal to establish fluid communication between the flowline and the formation.

As shown in FIG. 8A, a tubing 813 may be used to connect the flowline 812 in the sample block 806 to the fluid sample line 814 in the tool 800. The connection between the flowline 812 and the tubing 813 puts the sample probe 807 in fluid communication with fluid sample line 814.

The tubing 813 is preferably a flexible tubing that maintains the connection between the second flowline 812 and the fluid sample line 814 when the sampling block 806 is rotated. The tubing 813 enables relative movement between the flowline 812 in the sample block 806 and the fluid sample line 814 in the tool 800, while still maintaining the fluid communication. For example, FIG. 8B shows the tool 800 with the sample block 806 rotated so that the coring bit 808 is adjacent to the opening 804. The tubing 813 has also moved so that fluid communication is still maintained between the flowline 812 in the sample block 806 and the fluid sample line 814 in the tool 800.

In some embodiments, the tubing 813 is a telescoping hard tubing that allows for a dynamic range of positions. Other types of tubing or conduit may be used without departing from the scope of the invention.

To obtain a sample, the sample block 806 extends through the opening 804 so that the sealing surface 810 (e.g., a packer, as shown in FIGS. 8A and 8B) contacts the formation (not shown). The sealing surface 810 presses against the formation so that the flowline 812 is in fluid communication with the formation. Formation fluid may be drawn into the tool body 802 through the flowline 812.

The coring bit 808 in the sample block 806 may be advanced into the formation to obtain a core sample of the formation material. FIG. 8B shows the tool 800 with the sample block 806 rotated so that the coring bit 808 is adjacent to the opening 804. In this position, the coring bit 808 may be extended to take a core sample from the formation (not shown). Once a core sample is captured in the coring bit 808, the coring bit 808 may be retracted back into the tool 800. FIG. 8B shows the coring bit 808 in a retracted position.

Referring again to FIG. 8A, once a core sample is captured in the coring bit 808, the sampling block 806 may be rotated so that the coring bit 808 is in a vertical position. From this position, a core pusher 823 may push the sample core (not shown from the coring bit 808 into a core passage 822. In some embodiments, the core may be stored in the core passage 822. In other embodiments, the core passage 822 may lead to a core sample storage mechanism, such as the one shown in FIG. 8C.

FIG. 8C shows a core sample storage chamber 850 in accordance with one embodiment of the invention. The core sample storage chamber 850 may be located just below a coring bit and ejection mechanism, such as the coring bit 808 and core pusher 823 shown in FIG. 8A. A core sample may be moved or passed into the core sample chamber 850 so that it may be retrieved at a later time for analysis.

A core sample chamber 850 may include gate valves 852, 853. The gate valves 852, 853 may be used to isolate sections of the core sample chamber 850 into separate compartments so that a plurality of core samples may be stored without contamination between the samples. For example, lower gate valve 853 may be closed in preparation for storing a core sample. A core sample may then be moved into the core sample chamber 850, and the lower gate valve 853 will isolate the core sample from anything below the lower gate valve 853 (e.g., previously collected core samples). Once the core sample is in place, the upper gate valve 852 may be closed to isolate the core sample from anything above the upper gate valve 852 (e.g., later collected core samples). Using a plurality of gate valves (e.g., valves 852, 853), a core sample chamber may be divided into separate compartments that are isolated from other compartments.

It is noted that isolation mechanisms other than gate valves may be used with the invention. For example, an iris valve or an elastomeric valve may be used to isolate a compartment in a core sample chamber. The type of valve is not intended to limit the invention.

In some embodiments, a core sample chamber 850 may be connected to the fluid sample line 814 by a fill line 857. The fill line may include a fill valve 856 for selectively putting the core sample chamber 850 in fluid communication with the fluid sample line 814. In some embodiments, the core sample chamber 850 may be connected to the borehole environment through an ejection line 855. An ejection valve 854 may be selectively operated to put the core sample chamber 850 in fluid communication with the borehole. The term "borehole" is used to the inside of the borehole is sealed from the formation. Where the flowline (e.g., 812 in FIG. 8A) is in fluid communication with the formation, in some embodiments, the ejection line 855 is in fluid communication with the borehole.

The fill line 857 enables a fluid sample to be stored in the same compartment of a core sample chamber as the sample core that was taken from the same position in the borehole. Once a core sample in a stored position (i.e., between gate valves 852, 853, which are closed), the fill valve 856 and sample fluid may be pumped into the core sample chamber, in the same compartment as the core sample. The ejection line 855 enables fluid to be ejected into the borehole until the core sample is completely immersed in the native formation fluid from that location.

In FIG. 8C, the fill line 857 is connected to a compartment (i.e., between gate valves 852, 853) near the top of the compartment, and the ejection line 855 is connected near the bottom of the compartment. A core sample may be stored in a position with the edge that formed part of the borehole wall facing down. In this position, the areas of the core sample that have been affected by mud invasion are near the bottom of the core sample. By connecting the fill and ejection lines 857, 855 at the top an bottom of the compartment, respectively, the sample fluid may flush the mud filtrate out of the core sample as the compartment is being filled with native formation fluid (i.e., a fluid sample).

FIG. 9 shows a cross section of a portion of a coring tool 900 including a combined formation testing and coring tool 901 in accordance with one embodiment of the invention. The combined formation testing and coring tool 901 includes a probe 903 with a coring bit 902 positioned therein. The probe may be selectively extended to contact the wellbore wall and create a seal with the formation. The coring bit 902 may then be selectively extended (with or without extension or retraction of the probe) to engage the wellbore wall.

the coring bit 902 of FIG. 9 is shown in a retracted position, but may be extended into the formation 912 to obtain a core sample. The coring tool 900 also preferably includes a core pusher or ejector 904. Once a core sample is received in the coring bit 902, the coring bit 902 may be rotated and the core pusher 904 may be extended to eject the core sample from the coring bit 902 and into a storage chamber (not shown). The combined formation testing and sampling assembly may be retracted into the downhole tool and rotated so that the core sample may be ejected into the sample chamber. Alternatively, the core sample may be retained in the coring bit for removal upon retrieval of the downhole tool to the surface.

The probe 903 also includes a fluid seal or packer 906 and a flowline 908 for taking fluid samples. When the packer 906 is pressed against the formation wall, the flowline 908 is isolated from the borehole environment and in fluid communication with the formation. Formation fluids may be drawn into the coring tool 900 through the flowline 908.

The packer 906 creates a sealing area against the formation 912. Fluid communication with the formation is established inside the packer sealing area. An opening of the flowline 908 is preferably located inside the sealing area adjacent the packer 906. The flowline 908 is also preferably adapted to receive fluids from the formation via the sealing area. The coring bit 902 is extendable inside and through the sealing area of the packer 906.

In some embodiments, the coring tool of FIGS. 8-9 may be provided with sample chambers for storing core samples and/or fluid samples. In at least one embodiment, the coring tool may be used with a sample chamber that stores core samples in formation fluid taken from the same location in the borehole as the fluid sample (e.g., the sample chamber 850 shown in FIG. 8C). A downhole tool may include a separate sample chamber for storing fluid samples, as known in the art. The description above is not intended to limit the invention. The combined coring and sampling assembly may also be provided with a fluid pump (not shown), fluid analyzers and other devices to facilitate the flow of fluid the flowline and/or the analysis thereof.

Figure 10:
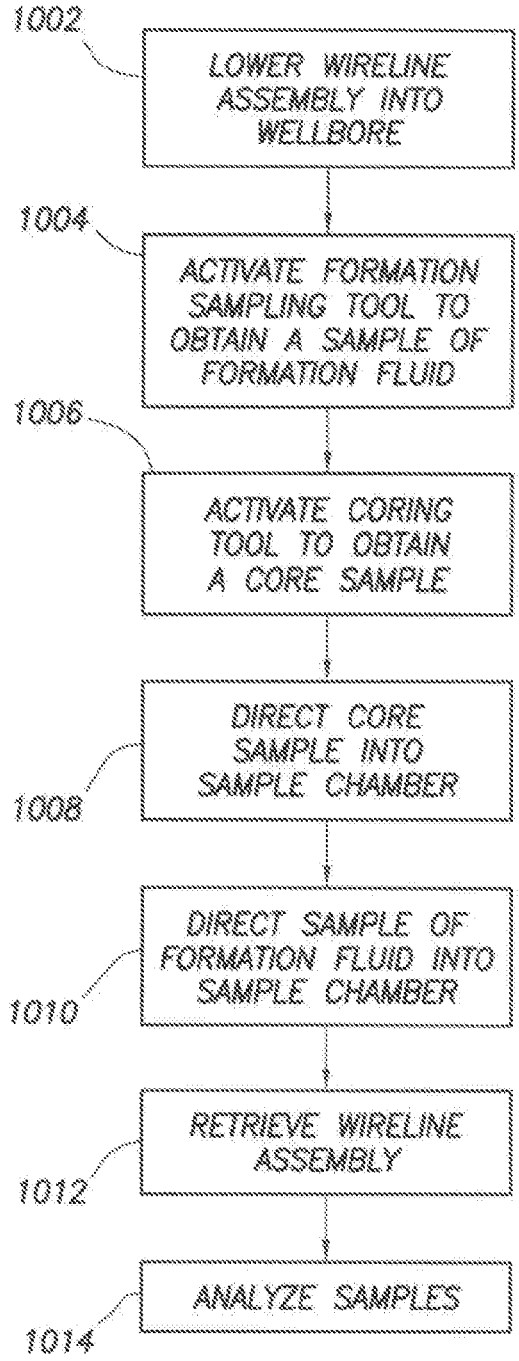
FIG. 10 shows one embodiment of a method in accordance with the invention.

FIG. 10 shows one embodiment of a method in accordance with the invention. The method includes lowering a wireline assembly into a borehole, at step 1002. The method also includes activating a formation testing tool connected in the wireline assembly to withdraw formation fluid from the formation fluid, at step 1004. The wireline assembly may also include a coring tool that is connected in the wireline assembly. The method may them include activating a coring tool connected in the wireline assembly to obtain a core sample, at step 1006.

Next, the method may include directing the core sample into a sample chamber, at step 1008; and directing the fluid sample into the sample chamber, as 1010. Steps 1008, 1010 are shown in this order because the core sample is preferably moved into the sample chamber before the fluid sample is then directed into the sample chamber. This enables the sample chamber to be filled completely with sample fluid after the core sample is already positioned in the sample chamber. However, those having ordinary skill in the art will realize that these steps may be performed in any order. It is also noted that steps 1008, 1010 are not required in all circumstances. For example, a core sample may remain in the coring bit for transportation to the surface.

Finally, the method may include retrieving the wireline assembly and analyzing the samples, at steps 1012, 1014. The analysis of the sample may provide information that is used in further drilling, completion, or production of the well.

Figure 11:
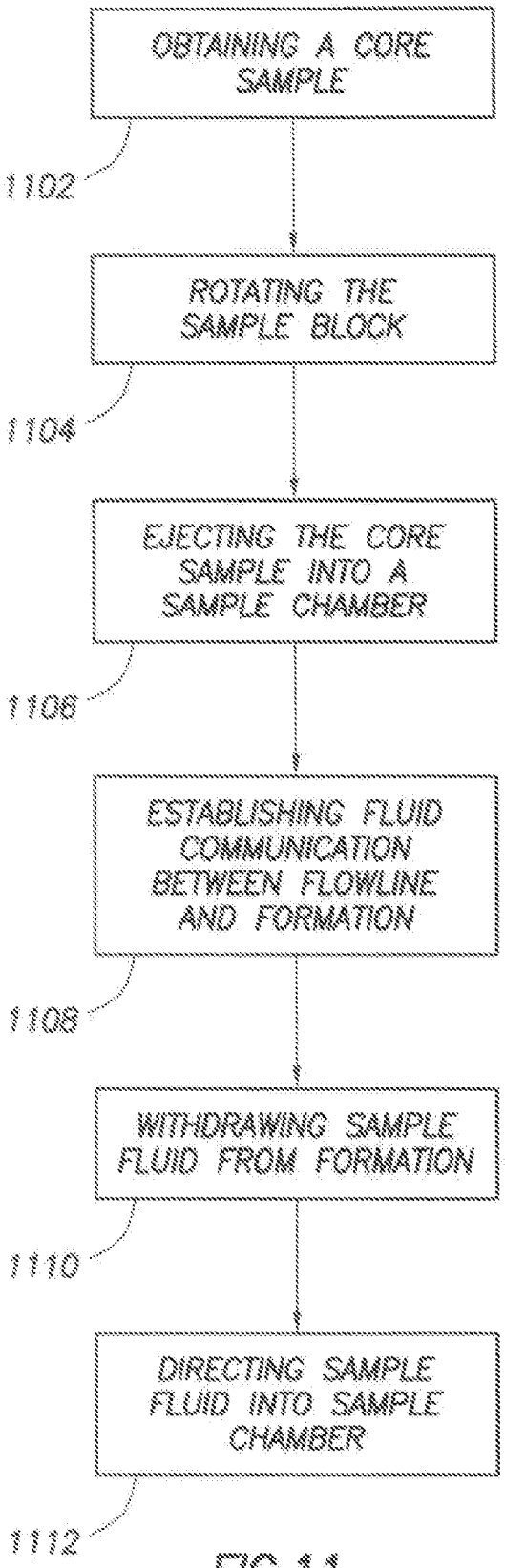
FIG. 11 shows one embodiment of a method in accordance with the invention.

FIG. 11 shows another embodiment of a method in accordance with the invention. The method includes obtaining a core sample of the formation rock, at step 1102. This step may be accomplished by extending a coring bit to the formation and applying a torque and a WOB to the coring bit.

Next, the method may include rotating a sample block in the downhole tool, step 1104. This will rotate the coring bit so that the sample core may be ejected from the coring bit, step 1106. The method may also include establishing fluid communication between a flowline and the formation, step 1108. Then, fluid may be withdrawn from the formation, step 1110. Finally, sample fluid is preferably directed into a sample chamber, step 1112.

Figure 12:
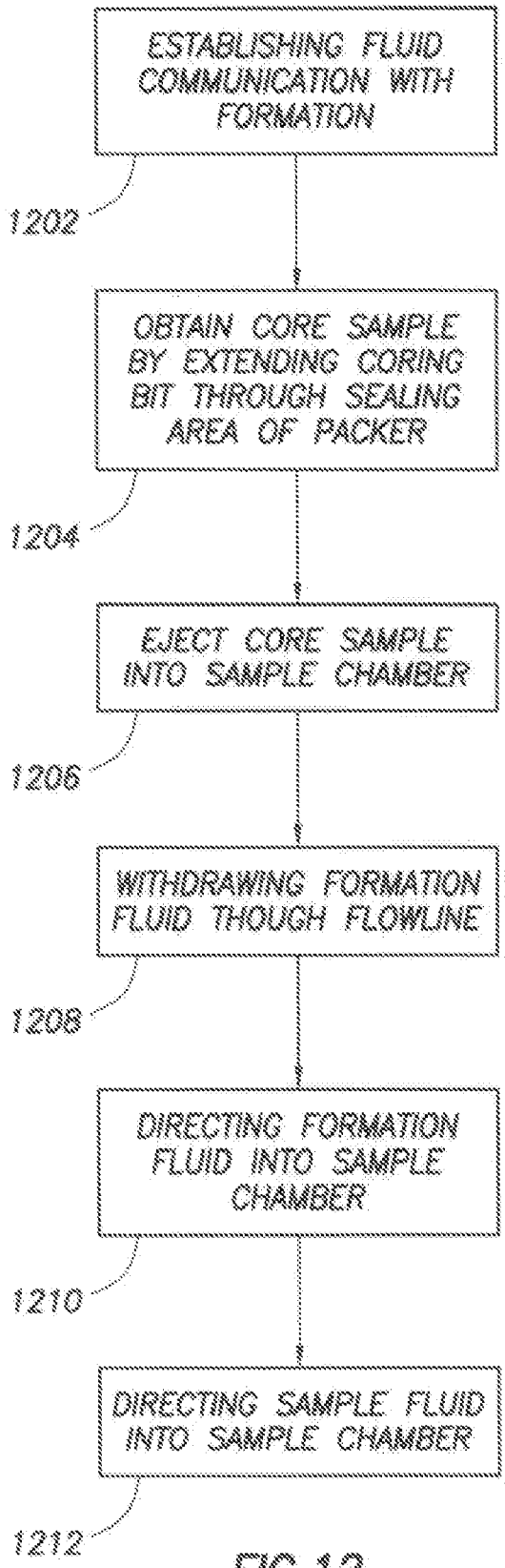
FIG. 12 shows one embodiment of a method in accordance with the invention.

FIG. 12 shows another embodiment of a method in accordance with the invention. The method includes establishing fluid communication with the formation, step 1202. Next, the method may include obtaining a coring sample by extending the coring bit through a sealing area of the packer, step 1204. It is noted that a core sample may be obtained before fluid communication is established. The order should not be construed to limit the invention.

The method may include ejecting the sample core from the coring bit into a sample chamber, step 1206. The method may also include withdrawing a fluid sample from the packer seal, step 1210.

Finally, the method may include directing the sample fluid into the sample chamber, step 1212.

Embodiments of the present invention may present one or more of the following advantages. Some embodiments of the invention enable both a coring tool and a formation testing tool to be included on the same wireline or LWD assembly. Advantageously, this enables core samples and fluid samples to be obtained from the same position in a borehole. Having both a core sample and a fluid sample from the same position enables the analysis of the formation and its contents to be more accurate. Additionally, one or more separate or integral coring and/or sampling components may be provided in a variety of configurations about the downhole tool.

Advantageously, certain embodiments of a coring tool operate with a high efficiency. Higher efficiency enables a coring tool to be operated using less power.

Advantageously, embodiments of the invention that include a low-power coring tool enable a core sample to be obtained using less power than the prior art. In certain embodiments, a low-power coring tool uses less than 1 kW of power. Advantageously, the circuitry that is required to deliver power to a low-power coring tool is much less demanding than that required with prior art coring tools. Thus, a low-power coring tool may be used in the same wireline assembly with other downhole tools that typically cannot deliver the high power required by prior art coring tools.

Some embodiments of a coring tool in accordance with the invention include PWM solenoid valves as part of a feed-back loop to control the hydraulic pressure applied to a kinematics piston or other device that applies WOB. Advantageously, a PWM solenoid valve may be precisely controlled so that the WOB is maintained at or near a desired value.

In at least one embodiment, a PWM solenoid valve is controlled based on a torque that is delivered to a coring bit. Advantageously, a coring tool with such a control device may precisely control the PWM solenoid valve so that the pressure applied to a kinematics piston results in a substantially constant torque delivered to the coring bit.

Some embodiments of the invention relate to a wireline assembly that includes a field joint with female socket holes located in the bottom of a tool or module. Advantageously, fluid cannot be trapped in the female socket holes, and the field joint will be relatively free of interference with the electrical contacts. Advantageously, some embodiments include a protective sleeve to prevent damage to male pins that may be disposed at the top of a module or tool. Additionally, embodiments of a protective sleeve that are perforated or porous enable fluid that might interfere with an electrical contact to flow through the protective sleeve and away from the electrical contacts.

Some embodiments of a wireline assembly in accordance with the invention include a sample chamber that enables a core sample to be stored in the same chamber or compartment as a fluid sample. Advantageously, a core sample may be stored while being surrounded by the formation fluid that is native to the position where the core sample was taken.

Advantageously, a sample chamber with one or more fill and ejection lines enables formation fluid to be pumped through the sample chamber while a core sample is in the sample chamber. Advantageously, at least a portion of the mud filtrate in the core sample (i.e., the mud filtrate that invaded the formation before the core sample was obtained) may be purged from the core sample and from the sample chamber.

While the invention has been described with respect to a limited number of embodiments, those skilled in the art, having benefit of this disclosure, will appreciate that other embodiments can be devised that do not depart from the scope of the invention as disclosed herein. Accordingly, the scope of the invention should be limited only by the attached claims.

What is claimed is:

1. A downhole tool positionable in a wellbore penetrating a subterranean formation, the subterranean formation having a formation fluid therein, comprising:

a housing;

a coring bit disposed in the housing, the bit being extendable from the housing for engaging a wellbore wall; and a sample chamber for storing at least two formation samples obtained with the coring bit, wherein the sample chamber includes at least two portions for separately storing the formation samples.

2. The downhole tool of claim 1, wherein the sample chamber is fluid coupled to a flowline providing sample fluid obtained from the formation.

3. The downhole tool of claim 1, wherein the sample chamber includes an elongate hollow shaft and a plurality of gates for opening and closing the portions of sample chamber.

4. The downhole tool of claim 3, wherein the gates are actuatable.

5. A sample storage assembly for a downhole coring tool positionable in a wellbore penetrating a subterranean formation, the subterranean formation having a formation fluid therein, comprising:

a first portion for receiving a first sample; and a second portion for receiving a second sample, wherein the first and second samples are selectively isolated.

6. The sample storage assembly of claim 5, wherein the first and second portions at least partially define a sample chamber.

7. The sample storage assembly of claim 5, wherein the first portion includes at least one gate for providing and restricting access of the first sample to the first portion.

8. The sample storage assembly of claim 7, wherein the at least one gate is a gate valve.

9. The sample storage assembly of claim 7, wherein the second portion includes at least one gate for providing and restricting access of the second sample to the second portion.

10. The sample storage assembly of claim 9, wherein the at least one gate of the first and the second portion define opposing ends of the second portion.

11. A method of storing a plurality of samples obtained from a subterranean formation in a downhole tool positionable in a wellbore penetrating the subterranean formation, the method comprising:

removing a first sample from a coring bit;

placing the first sample into an opening defining an entrance into a storage assembly;

sealing the first sample in a first portion of the storage assembly;

removing a second sample from a coring bit;

placing the second sample into the opening; and sealing the second sample in a second portion of the storage assembly, wherein the first and second samples are isolated from each other.

12. The method of claim 11, wherein sealing the first sample includes sealing a first portion of the storage assembly near a second end of the first sample.

13. The method of claim 12, wherein sealing the portion of the storage assembly near the second end of the first sample further includes sealing a first end of the second portion of the storage assembly.

14. The method of claim 11, further including traversing the first sample through the second portion of the storage assembly before arriving at the first portion.

15. A method of storing a plurality of samples obtained from a subterranean formation in a downhole tool positionable in a wellbore penetrating the subterranean formation, the method comprising:

placing a first sample into a first portion of a storage assembly, the first portion having a first end and a second end;

sealing the second end of the first portion, thereby defining a first end of a second portion; and placing a second sample into the second portion of the storage assembly.

16. The method of claim 15, further including sealing a second end of the second portion thereby sealing the second sample in the second portion.

17. The method of claim 15, further including traversing the first sample through the second portion of the storage assembly before arriving at the first portion.

* * * * *